United States Patent [19]

Newns et al.

[11] 4,197,159

[45] Apr. 8, 1980

[54] FLOWBOXES

[75] Inventors: Michael D. Newns; Brian W. Attwood, both of Bristol, England

[73] Assignee: St. Anne's Board Mill Company Limited, Bristol, England

[21] Appl. No.: 931,972

[22] Filed: Aug. 8, 1978

[30] Foreign Application Priority Data

Sep. 2, 1977 [GB] United Kingdom ..... 36838/77

[51] Int. Cl.[2] ..... D21F 1/02

[52] U.S. Cl. ..... 162/346; 162/336

[58] Field of Search ..... 162/336, 346, 366, 216

[56] References Cited

U.S. PATENT DOCUMENTS

| | | | |
|---|---|---|---|
| 3,281,314 | 10/1966 | Bennett | 162/346 |
| 3,493,463 | 2/1970 | Baker | 162/336 |
| 3,565,758 | 2/1971 | Higgins et al. | 162/336 |
| 4,081,321 | 3/1978 | Wolf | 162/346 |
| 4,083,750 | 4/1978 | Newns et al. | 162/336 X |

FOREIGN PATENT DOCUMENTS

| | | |
|---|---|---|
| 416890 | 9/1934 | United Kingdom . |
| 664917 | 1/1952 | United Kingdom . |
| 1022090 | 3/1966 | United Kingdom . |

*Primary Examiner*—Richard V. Fisher

*Attorney, Agent, or Firm*—Larson, Taylor and Hinds

[57] ABSTRACT

A flowbox for a paper or board web-making machine is provided with at least one side wall movable along an axis at right angles to the direction of stock flow through the flowbox, whereby the width of the flowbox may be varied and the web deckled before it leaves the flowbox.

5 Claims, 6 Drawing Figures

FLOWBOXES

This invention relates to improvements to flowboxes for machines for dewatering fibrous pulp or stock to form a sheet, e.g. in the manufacture of paper or board.

The invention particularly relates to improvements in the type of flowbox having a component known in the art as an "explosion chamber", which is a chamber in which a high speed stream of stock is very quickly changed in speed and direction of flow by rapid expansion and/or impingement on an obstruction within the chamber, whereby the stream disintegrates or "explodes" to cause mixing and deflocculation of the stock by the generation of turbulance. One such explosion chamber is described in our U.K. Pat. No. 1179847 (equivalent to U.S. Pat. No. 3,565,758).

Long-fibre free-beaten cellulosic stock cannot easily be utilized in flowboxes incorporating explosion chambers of the prior art. This difficulty was overcome by the invention described and claimed in our U.S. Pat. No. 4,083,750 wherein there is provided a flowbox for a paper, board or similar fibrous web making machine, the flowbox comprising an enclosed explosion chamber having upstream and downstream convergent wall portions converging from a top wall portion towards a bottom wall portion, wherein a stock inlet is disposed in the upstream wall portion and is directed towards the downstream wall portion so that a jet of stock emanating from the inlet impinges against the downstream wall portion adjacent the region of closest approach of the upstream and downstream wall portions. The stock outlet is provided by non-divergent upper and lower plates defining an exit slice, the lower plate being a continuation of the bottom wall portion. The lower plate may be shorter than the upper plate.

In U.S. Pat. No. 4,083,750, the flowbox of, in its embodiment of having a lower slice plate shorter than the upper slice plate, is also described and claimed in combination with a dewatering means, such as a foil box or suction box, wherein the dewatering means is located underneath the projecting end of the upper slice plate.

Figure 1:
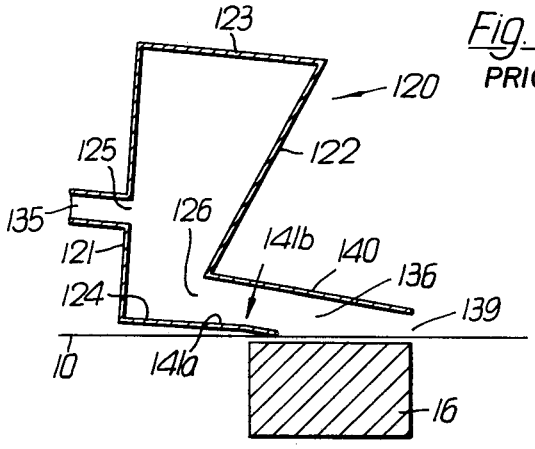
Fig. 1. PRIOR ART
Figure 2:
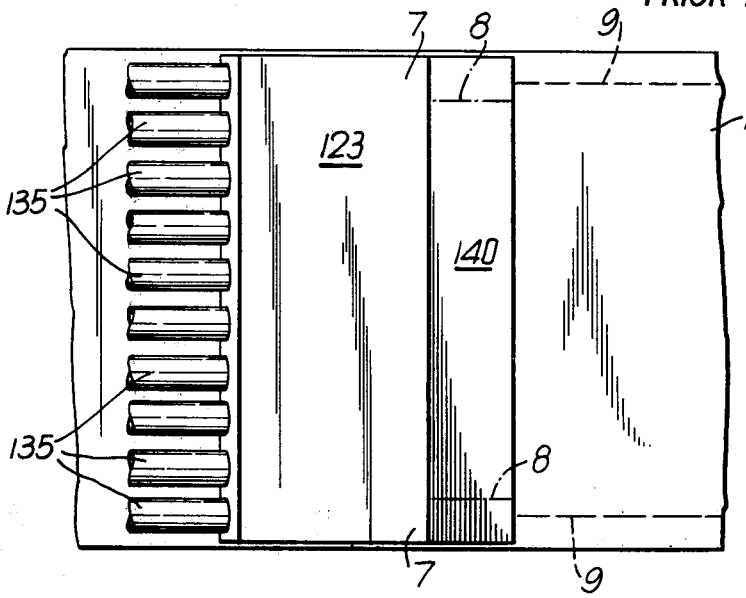
Fig. 2. PRIOR ART

Referring to FIGS. 1 and 2 of the accompanying drawings,

FIG. 1 is a cross-section side view of a flowbox according to U.S. Pat. No. 4,083,750, and FIG. 2 is a plan view of the apparatus shown in FIG. 1.

Figure 3:
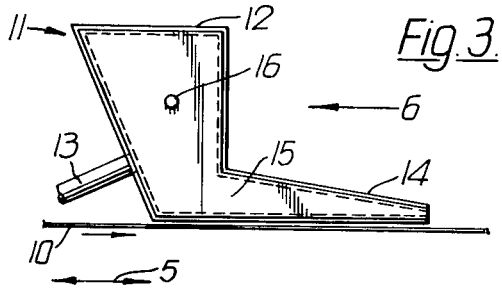
Figure 4:
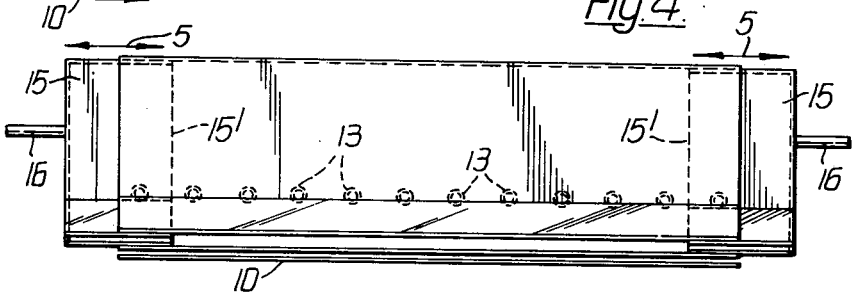
Figure 5:
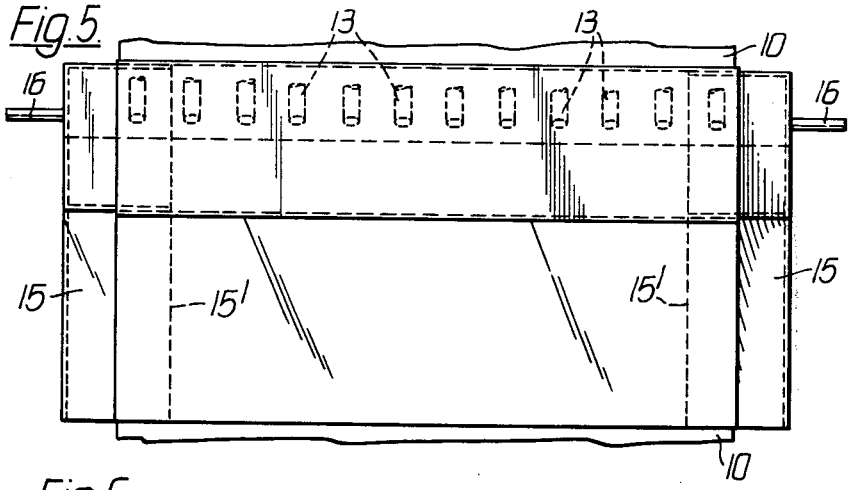
Figure 6:
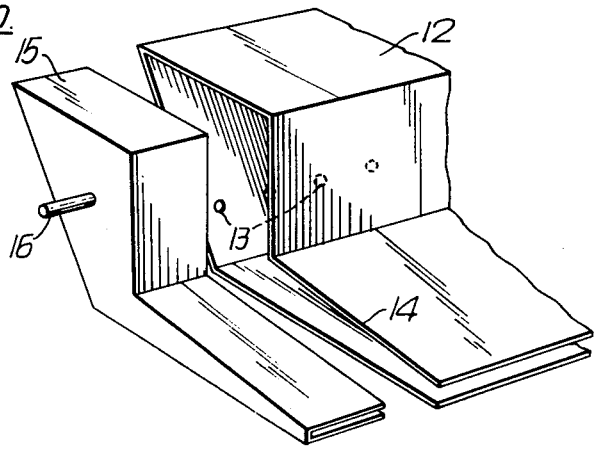

FIG. 3 is a view from one side of a flowbox according to the present invention, FIG. 4 is a view of the flowbox of FIG. 3 taken in the direction of arrow 6, FIG. 5 is a plan view of the flowbox, and, FIG. 6 is a perspective exploded view of a portion of the flowbox.

In FIGS. 1 and 2 there is shown, extending across the width of a machine wire 10, an explosion chamber 120 comprising a closed metal box of quadrilateral cross-section defined by planar walls 121–124 forming respectively upstream, downstream, top and bottom walls of the chamber. "Upstream" is used to refer to the input side of the explosion chamber.

The upstream and downstream walls converge from the top wall to the bottom wall. The top and bottom walls are substantially parallel, the upstream wall is substantially perpendicular to the machine wire 10, the angle of convergence between the upstream and downstream walls is about 25°, and the distance between the top and bottom walls is greater than the distance between the upstream and downstream walls at their greatest separation. An outlet 126 is provided in the bottom portion of downstream wall 122, immediately adjacent bottom wall 124. Outlet 126 communicates with a slice 139 by a shear-flow passage or channel 136. Stock from the slice 139 is directed onto the wire 10.

Stock inlet tubes are provided by tubes 135 directing stock into the explosion chamber through apertures 125 in wall 121.

The apertures 125 are located in the lower portion of the wall 121 in a position such that the flow of stock is directed at an angle to the downstream wall 122, and such that the flow from the tubes does not proceed directly into the outlet 126.

The stock inlet tubes may be arranged in a number of ways whereby the stock is fed into the explosion chamber, the criterion being that as the stock emanates from the inlet tubes into the explosion chamber at high speed it is directed upwards to impinge against downstream wall 122. The stock is then directed from downstream wall 122 towards the top wall and is caused to circulate violently in the chamber so that entangled fibre clots are torn apart. The deflocculated stock in the lower portion of the chamber is forced towards the outlet 126 and impingement against the bottom wall 124 of the chamber causes a violent change in the direction of flow, further assisting the deflocculating effect. Due to the restricted enclosed nature of the explosion chamber, the resulting high-speed extremely turbulent deflocculated well-mixed stock immediately leaves the explosion chamber via the relatively narrow outlet 126.

The shear-flow channel 136 is defined by an upper slice plate 140 and a lower, shorter, slice plate **141*a*. The purpose of the short lower plate 141*a* is to enable well-formed stock to be used in a web-forming operation immediately on leaving the explosion chamber, thereby minimizing reflocculation in the stock during its transit from the explosion chamber to the web-forming operation and permitting the formation of a fibrous mat on a wire underneath the top plate 140 before the stock emerges from the exit 139** into contact with free air. This avoids jet instabilities which can occur when fibrous suspension is projected from a slice gap into free air before descending onto a wire, and which can cause undesirable streaks and flocculation in the web formed therefrom.

A flexible apron **141*b* is provided depending from the lip of lower plate 141*a* onto the wire 10 so as to prevent back-flow of stock under the lower plate 141*a***.

In FIG. 1 the explosion chamber 120 is shown in relation to a forming wire 10, and is characterized in that a dewatering means such as a suction box 16 is located under the wire 10 immediately after the lower slice plate **141*a*. The open area of the suction box 16 can extend as far as the limits of the upper slice plate 140. Consequently, well-formed stock applied to the wire 10 is virtually simultaneously dewatered as soon as it reaches the wire. It will be appreciated that a well-formed web is therefore formed in a very short distance (for example 10–20 cm) and significant savings in machinery space are achieved. The well-formed web on the wire 10** may be further dewatered on the wire by means already known in the art.

It is sometimes required to produce a web that is narrower than the width of the shear-flow channel 136. This may be achieved by deckling the edges of the web when on the wire 10, e.g. to the width indicated by the dashed lines 9 in FIG. 2. The disadvantage of this is that there is wastage of web material lying outside the lines 9. Alternatively, narrower slice plates 140, 141*a* may be provided, as indicated by chain lines 8 in FIG. 2. Although this results in no wastage of web material it has the disadvantage that the narrower slice can cause a build-up or clogging of stock fibres in the corners 7 of the explosion chamber that are adjacent the slice.

It is an object of the present invention to overcome the above disadvantages.

According to the present invention there is provided a flowbox for a paper, board or similar fibrous web making machine, the flowbox comprising an enclosed explosion chamber having a stock inlet disposed in an upstream wall and a stock outlet disposed in a downstream wall wherein the chamber is provided with a side wall movable along an axis at right angles to the direction of stock flow through the explosion chamber, the shape of the side wall being substantially congruent to the cross-section of the chamber taken at right angles to said axis, whereby the width of the explosion chamber may be varied.

The stock outlet preferably comprises an aperture extending across the downstream wall and feeding into an exit slice defined by opposed upper and lower slice plates, and the side wall is preferably provided with an extension providing a side wall for the slice, whereby movement of the chamber side wall across the chamber causes a corresponding movement of the slice side wall across the width of the slice.

There may be provided two such side walls, each with its extension, at opposed ends of the flowbox.

Referring to FIGS. 3–6 there is shown a flowbox 11 comprising an explosion chamber 12, a series of inlet tubes 13 feeding into the chamber 12, and a tapering exit slice channel 14 feeding from the explosion chamber 12 onto a forming wire 10.

The construction of the flowbox 11 is similar to that of the flowbox 120 of FIGS. 1 and 2, but, whereas the flowbox 120 of FIGS. 1 and 2 is provided with fixed side walls (not shown, but parallel to the plane of FIG. 1), the flowbox 11 of FIGS. 3–6 is provided with a pair of opposed movable side walls 15 each of which is congruent to the side cross-section of the flowbox and is arranged to be slid in and out of the flowbox in the directions 5 of FIG. 4 to the position shown by the chain line 15' in FIGS. 4 and 5, that is, in directions at right angles to the flow of stock through the chamber. Adjustment of the side walls 15 in and out of the chamber is effected by rods 16 attached to the outside portions of the walls 15. The rods 16 may be handled manually or by machinery (not shown).

It will be seen that each side wall 15 has a major portion which is congruent to the explosion chamber 12, and a minor portion or extension which is congruent to the slice section 14 of the flowbox. It will be understood that in some applications it may be desirable not to have the said minor portion or extension of the side wall 15 but to have a fixed (non-movable) side wall for the slice section 14.

Thus the invention provides a means for varying the width of an explosion chamber flowbox within the explosion chamber, and, if necessary, within the slice, and thereby overcome the alternative disadvantages mentioned above of deckling the web when on the wire (thus resulting in wastage) or of narrowing the width of the slice (thus causing clogging of fibres in corners of the explosion chamber).

What we claim is:

1. A flowbox for a fibrous web making machine, the flowbox comprising an enclosed explosion chamber having an upstream wall, a downstream wall and a pair of sidewalls, a top wall and a bottom wall, the upstream and downstream walls converging from the top wall to the bottom wall, means defining a stock inlet disposed in the upstream wall and directed towards the downstream wall so that a jet of stock emanating from the stock inlet impinges against the downstream wall adjacent the region of closest approach of the upstream and downstream walls, means mounting at least one of said side walls for movement along an axis at right angles to the direction of stock flow through the explosion chamber, the shape of the side walls being substantially congruent to the cross section of the chamber taken at right angles to said axis whereby the width of the explosion chamber may be varied.

2. A flowbox according to claim 1 and further including means for mounting both of said sidewalls for movement along an axis at right angles to the direction of stock flow through the explosion chamber.

3. A flowbox according to claim 1 wherein the means defining said stock outlet comprises an aperture extending across the downstream wall and further including opposed upper and lower slice plates and opposed slice side walls forming an exit slice, said stock outlet feeding into the exit slice.

4. A flowbox according to claim 3 wherein at least one of the slice side walls comprises an extension of a corresponding chamber side wall whereby movement of said corresponding chamber side wall across the chamber causes a corresponding movement of the slice side wall across the width of the slice.

5. A flowbox according to claim 3 wherein the slice side walls are fixed in position in relation to the slice plates.

* * * * *